US005802812A

United States Patent [19]

Heudecker

[11] Patent Number: 5,802,812

[45] Date of Patent: Sep. 8, 1998

[54] PROCESS AND DEVICE FOR THE PROCESSING OF CONTAINERS

[75] Inventor: Gerhard Heudecker, Pentling, Germany

[73] Assignee: Krones AG Hermann Kronseder Maschinenfabrik, Neutraubling, Germany

[21] Appl. No.: 589,714

[22] Filed: Jan. 22, 1996

[30] Foreign Application Priority Data

Jan. 26, 1995 [DE] Germany ..... 195 02 452.4

[51] Int. Cl.[6] ..... B65B 55/18

[52] U.S. Cl. ..... 53/431; 53/432; 53/488; 53/485; 53/510; 53/287

[58] Field of Search ..... 53/111 R, 431, 53/432, 287, 510, 317, 485, 488, 490; 426/397, 399, 403, 404

[56] References Cited

U.S. PATENT DOCUMENTS

| | | | |
|---|---|---|---|
| 2,127,964 | 8/1938 | Ryan et al. | 53/432 |
| 2,131,876 | 10/1938 | Hurst | 53/510 |
| 2,630,957 | 3/1953 | Hohl et al. | 53/432 X |
| 3,246,447 | 4/1966 | Smith et al. | 53/510 X |
| 3,443,352 | 5/1969 | Mencacci | 53/432 |
| 4,099,361 | 7/1978 | Dix et al. . | |
| 4,485,854 | 12/1984 | Roullet | 53/432 X |
| 4,583,346 | 4/1986 | Kameda | 53/431 |
| 4,588,000 | 5/1986 | Malin et al. | 53/431 X |
| 4,662,154 | 5/1987 | Hayward | 53/431 |
| 4,703,609 | 11/1987 | Yoshida et al. | 53/431 |
| 4,729,204 | 3/1988 | Weiss | 53/510 X |
| 4,835,937 | 6/1989 | Meyer et al. | 53/426 X |
| 4,870,801 | 10/1989 | Mizandjian et al. | 53/510 X |
| 4,880,041 | 11/1989 | Yamada et al. | 53/431 X |
| 4,918,902 | 4/1990 | Honma et al. | 53/432 X |
| 4,977,723 | 12/1990 | Dubrulle et al. | 53/510 X |
| 5,033,254 | 7/1991 | Zenger | 53/431 |
| 5,251,424 | 10/1993 | Zenger et al. | 53/431 |
| 5,457,939 | 10/1995 | Bardou et al. | 53/431 X |

FOREIGN PATENT DOCUMENTS

| | | |
|---|---|---|
| 91/00982 | 12/1991 | European Pat. Off. . |
| 3226172 | 1/1984 | Germany . |
| 3311200 | 4/1984 | Germany . |

*Primary Examiner*—Daniel Moon

*Attorney, Agent, or Firm*—Tilton, Fallon, Lungmus & Chestnut

[57] ABSTRACT

The invention relates to a process, as well as a device which is suited for the same, for the processing of containers, particularly of bottles or the like, into which a fluid is injected for the expulsion of the air from the head room of the bottles after the filling, before the aperture of the container is closed, in a sealing manner, by means of a closure cap. After the injecting of the fluid, a closure cap is first of all moved forward to the opening of the container and held, for a certain period of time, in a position above the opening, in such a manner that the open aperture is covered by the closure cap, but that gas can exit from the container between the opening and the closure cap. After that, the closure cap is attached to the container in a sealing manner.

20 Claims, 4 Drawing Sheets

PROCESS AND DEVICE FOR THE PROCESSING OF CONTAINERS

BACKGROUND OF THE INVENTION

1. Field of the Invention

The invention relates to a process and a device for the processing of containers.

2. Description of the Related Art

During the decanting of oxygen-sensitive beverages, especially beer, attempts are made to prevent, by means of various measures, any enclosures of air within the head or neck space of the bottles before the closing of bottles which have just been filled, so that any deterioration of the contents of the bottle is thereby excluded. Thus, for example, a hot water jet is sprayed into the filled bottles, which are still open, by means of a high-pressure injecting device, in order to foam up the beer which is in the neck area of the bottle. Through the rise of the foam, which will ideally proceed precisely up to the opening of the bottle, a displacement of the air should be brought about before the sealing of the bottles (DE 33 11 200 C-1). In addition, attempts have also been made, immediately before the placing on and sealing of the closure cap, to displace the air which is contained within the area of the bottle opening and within the cap-shaped depression of the closure cap—such as, for example, a crown-type cap—by means of special inert gas blowing devices, this displacement being towards the closing tools.

These measures bring about an increased expenditure for construction.

The task which forms the basis of the invention is that of bringing about an improvement in this respect.

SUMMARY OF THE INVENTION

The task is solved by means of the process and the device as described herein.

By means of the solution which is proposed, an effective displacement of air from the space of the neck or the head of a bottle and, above all, out of the closure cap, before the definitive attachment of the closure cap, is made possible in the bottle, in the simplest manner, without having to provide additional inert gas blowing devices within the area of the closing tool. Through the fact that the closure cap is, after the injection process, moved forward to the opening of the bottle, but is not—in contrast to the previous manner of proceeding—immediately pressed against the opening in a sealing manner and attached by means of a molding, but is instead, first of all, held for a sufficiently long period of time at the opening of the bottle in a position which protects the open opening, the setting free or the release of the fluid which is strengthened by the injecting process in the internal space of the bottle can be used for the displacement of the air out of the depression of the closure cap. The fluid stream exiting from the internal space of the bottle through the opening thereby strikes against the internal side of the closure cap and is turned around to the edge of the closure cap in order, finally, to escape there through an aperture between the closure cap and the edge of the opening and thus out into the open air. At the same time, this type of forcefully-directed current flow brings about, in addition to the effective displacing of air in connection with the closure cap, a good protection of the opening of the bottle, which is still open, so that no turbulence can arise, even at high bottle conveying speeds, from the atmospheric air at the bottle opening which, without this protection, could have the penetration of air into the neck of the bottle as its result.

In order to attain the protective position of the closure cap, a corresponding adjustment of the height control is sufficient for the known types of closing machines which, as a rule, have a control cam against which the cam rollers of the individual closing tools abut. A modification of the course of the cam does not, however, bring about any greater construction expense and can be brought about in a simple manner. After a relatively short period of time, the closure cap can be definitively pressed against the opening and attached to the same.

The solution which is proposed here comes into discussion, in a particularly effective manner, if a liquefied gas, particularly liquid nitrogen, is injected into the bottles after the filling. An intensive release of gas in the internal space of the bottle is brought about through the fact that the liquefied gases vaporize upon entering the filled bottle. The development and flowing of gas which arises can, during the corresponding dosing, be powerful enough that the closure cap can, in the protective position, first of all even be applied directly to the opening. Through a rise in pressure within the internal space of the bottle, the closure cap can, upon a sufficiently high gas pressure, be raised, so that the flowing of the gas which has been mentioned above comes about between the closure cap and the opening, with the result of displacing the air.

The displacement of air through the evaporation of the liquefied gas brings about still further advantages, in comparison with the known type of foaming up of beverage by means of injected hot water or the like, such as, for example, a lower level of contamination of the external side of the bottle and of the closing tool as the result of the foam not overflowing. Through this fact, the danger of infections arising from closing tools contaminated by microorganisms is considerably reduced, since the nutritional basis for the undesirable microorganisms in the apertures of the closing tool as the result of the beer foam, which is now not present, is completely eliminated.

Additional advantageous configurations of the invention are stated in the following description of the invention.

One example of implementation will be illustrated in the following by means of the figures. These depict the following:

DESCRIPTION OF THE PREFERRED EMBODIMENT

Figure 1:
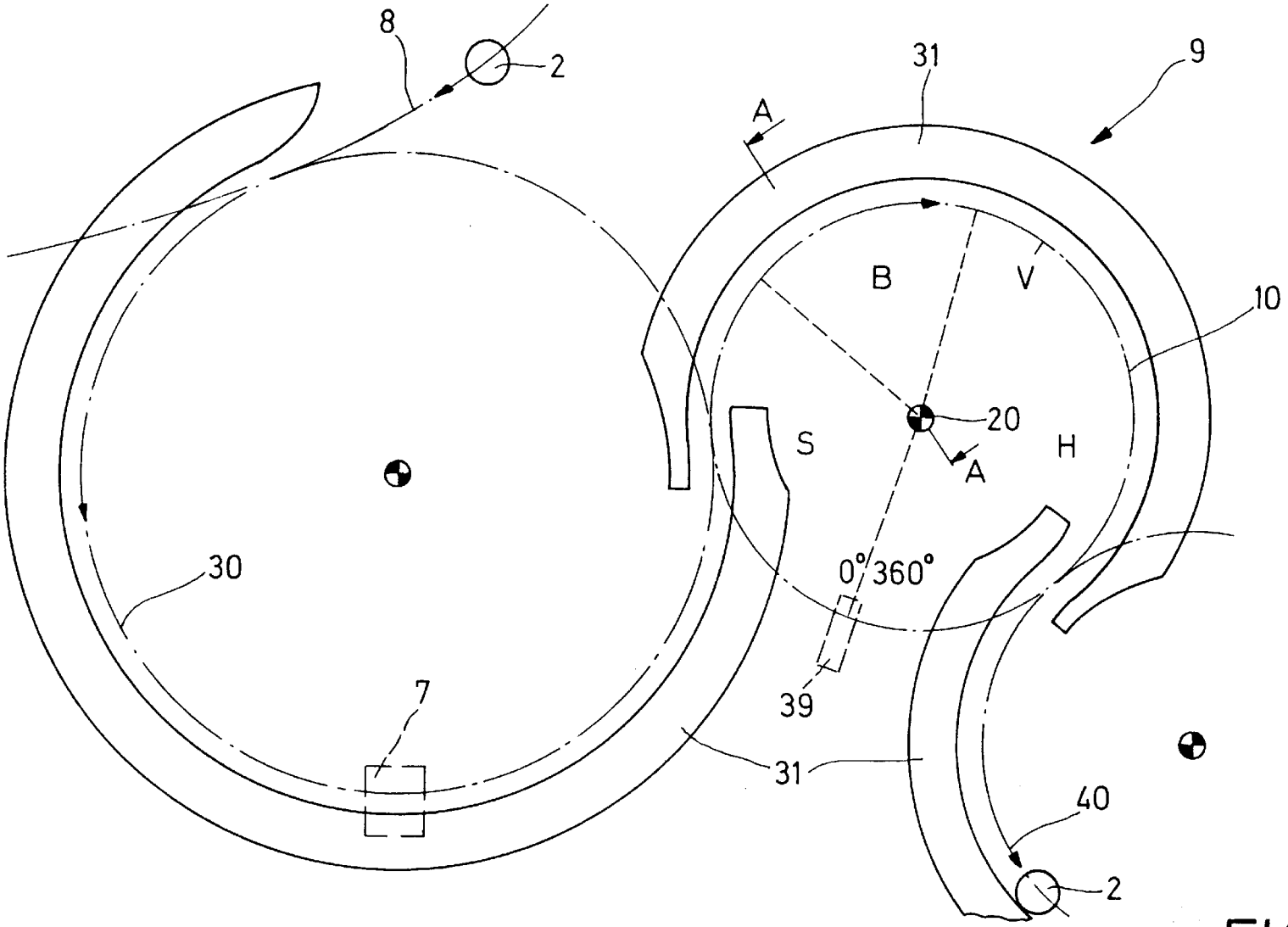
FIG. 1: A partial view from above of a device for the processing of containers.

FIG. 1 depicts a portion of a filling carousel (8), which is only indicated schematically by means of dotted lines, as well as the rotor (10), which is likewise only indicated schematically, of a closing machine (9), which machine is, in a manner suitable to its position, connected by means of a transfer star wheel (30) to the intake of the filling carousel (8), and is driven in a manner synchronous with the same. An injecting device (7) for the liquid nitrogen, which is positioned in a stationary manner, is positioned on the circular path of the transfer star wheel (30), between the filling carousel (8) and the inlet of the closing machine (9). In order to adapt to the characteristics of the beverage, the transport speed, the other parameters, as well as the position of the injecting device (7) can, in a manner which differs from the representation, be placed at a further distance, or else they can be positioned closer to the inlet of the closing machine (9), and/or the pressure of injection can be variable.

The rotor (10) of the closing machine (9) is equipped, in the manner which is known per se, with accommodating pockets, which are not depicted here, for the bottles (2) which are held in the accommodating pockets by means of guide rails (31) which are positioned in a stationary manner along the circular path. In order to move the sealed bottles (2) away from the closing device, an intake star wheel (40) is positioned at the intake of the same. In order to transport the closure cap, a closure cap conveyance station (39) is positioned on the circular path of the rotor (10) between the intake star wheel (40) and the transfer star wheel (30).

Figure 2:
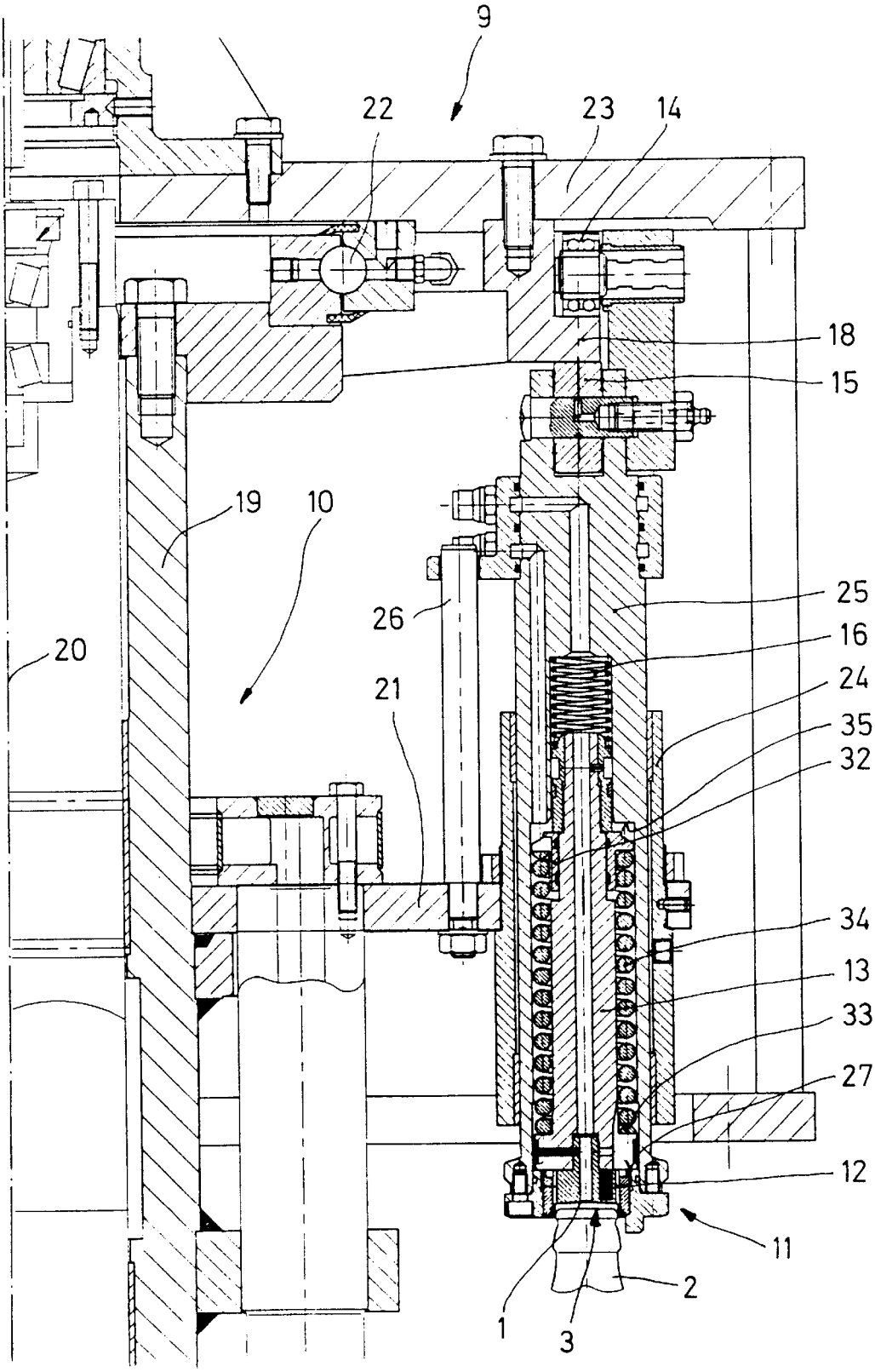
FIG. 2: A vertical partial section through the upper portion of a closing machine along the sectional line "A"—"A" in FIG. 1.

The construction of the closing device is evident from FIG. 2, which depicts a vertical section through the upper portion of the closing device from its internally-positioned rotational axis (20) up to its external periphery. It is evident from this representation that the rotor (10) essentially consists of a central shaft (19) which can be driven in a rotating manner, which has a supporting disk (21) which is attached rigidly to the same, and which disk has borings, which are distributed over its external circumference and placed in a semi-circle, in order to accommodate the closing tool (11). On the upper end of the central shaft (19), a carrier (23) which is held in a non-rotating manner, and to which a control cam (18). is attached, is supported by means of a pivot bearing (22).

A closing tool (11) consists of a guide tube (24) which is placed through the boring within the supporting disk (21) of the rotor (10), which has been noted above, within which tube is conducted a rod (25) which, in an elevatable and depressible manner, supports a closing cone (28) which is attached to its lower end in a changeable manner. The rod (25) is secured against rotation by means of a guide pilot unit (26) which is attached to the supporting disk (21) laterally next to the guide tube (24). A pair of cam rollers (14, 15) is attached to the upper end of the rod (25), whereby one guide roller (14) abuts with the upper side, and the second guide roller (15) abuts with the lower side, of the control cam (18). A pushing rod (13) is conducted, in a coaxially displaceable manner, within the interior of the rod (25), which pushing rod has, at its lower end, a magnet (12) for the secure holding of a crown-type cap (1). The pushing rod (13) is permanently stressed in the downward direction by means of a helical spring (16) which is comparatively non-rigid. Apart from the actual closing phase, during which the crown-type cap (1) is pressed against the opening of the bottle (3) and thereupon deformed by means of the flanging of its edge, and is thereby fastened, a first recessed surface (27) of the pushing rod (13) continuously abuts against the upper side of the closing cone (28) or of the carrier ring (29) (see FIG. 3). In addition, a sliding sleeve (32) is positioned, in a displaceable manner, on the pushing rod (13). A hard helical spring (34) is clamped between this sliding sleeve (32) and a second recessed surface (33) which is located on the lower end of the pushing rod (13). The pushing rod (13) can be displaced axially in an upward direction by itself, for a certain short distance, against the slight force of the non-rigid helical spring (16) relative to the rod (25), until the upper side of the sliding sleeve (32) is brought to application in a shoulder point (35) which is formed within in the rod (25). During a further displacement of the pushing rod (13) in an upward direction, the considerably higher force of the hard spring (34) which is then operative must additionally be overcome.

Figure 3:
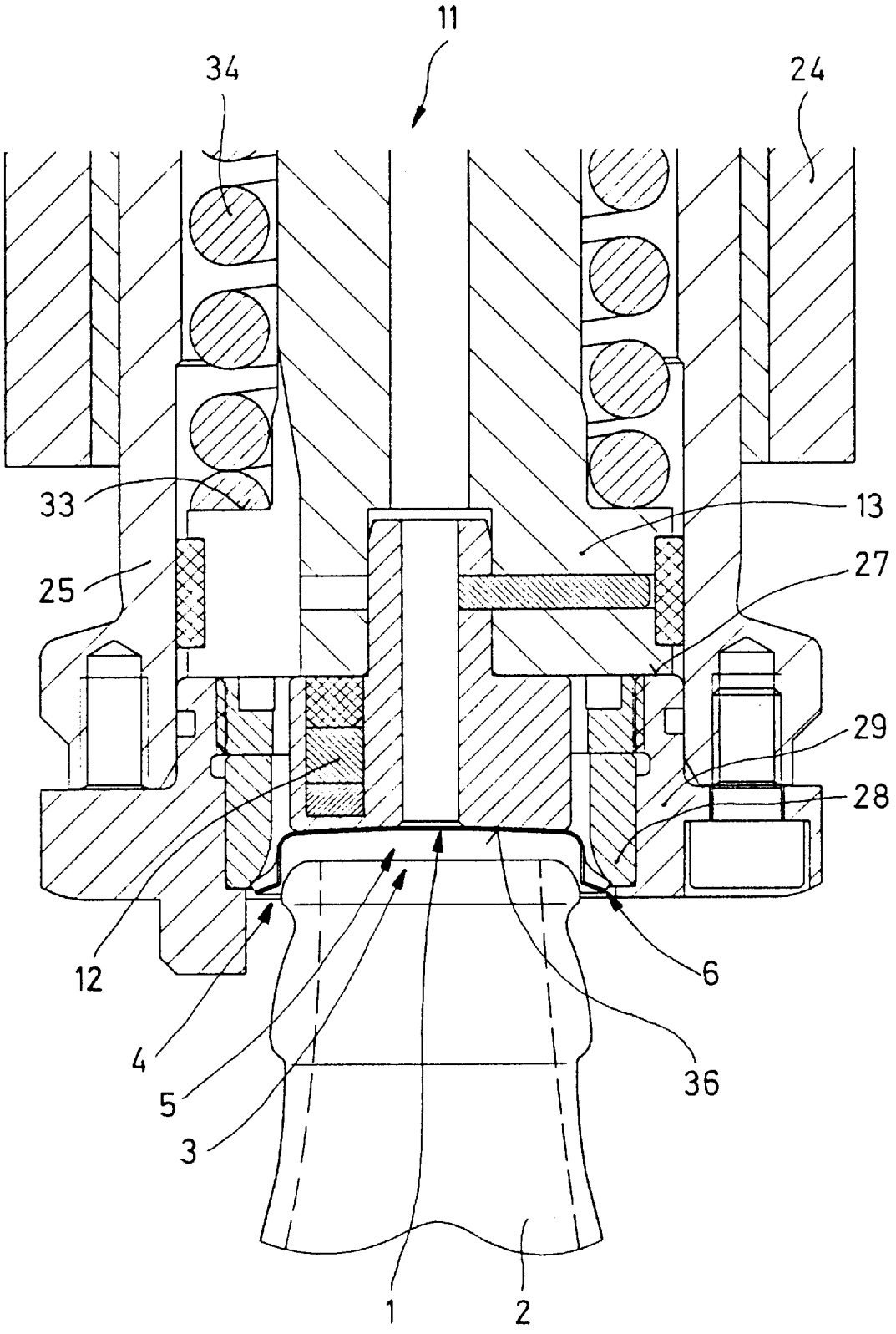
FIG. 3: A vertical section, depicted at an enlarged scale, through the actual closing tool.

The lower end of the closing tool (11) is depicted in enlarged depiction in FIG. 3. The lower end of the guide tube (24), with the rod (25) projecting from the same, is evident. At the end of the rod (25), a carrier ring (29), which serves for the changeable accommodation of the ring-shaped closing cone (28), is attached, in a detachable manner, by means of a screw. The closing cone (28) is partially engaged by means of a magnet (12) which is connected with the pushing rod (13) by means of pins, whereby the frontal side of the magnet (12) is set back—relative to the lower edge of the closing cone—into the interior. By this means, a centering of the crown-type cap (1) which is held by the magnet (12) is attained in the closing cone (28).

The position (II) of the closing tool (11) is depicted in FIGS. 2 and 3, in which the crown-type cap (1) covers or protects the opening (3) of the bottle (2), which has still not been definitively sealed. It is clearly evident, particularly from FIG. 3, that the upper side of the opening (3) is, in this position, spaced only a few millimeters from the internal frontal surface (36) of the crown-type cap (1). The distance may vary in dependence on the height tolerances of the bottle (2) which is placed on a stationary plate, which is not depicted here. The lower edge (6) of the crown-type cap (1) thereby lies below the opening (3), whereby a ring-shaped aperture (4) is present between the edge of the cap unit (1) which projects in a downward direction from the frontal surface (36) and the surface of the circumference of the opening. It can easily be understood that the gas which exits from the opening (3) first strikes the frontal side (36) of the cap unit (1) and is diverted to the edge of the cap unit (6), in order to then subsequently escape into the open through the aperture (4), which has been mentioned above, between the edge and the surface of the circumference of the opening. During this process, both those quantities of air which are possibly still present within the neck of the bottle, as well as the volume of air which was originally present in the depression (5) of the crown-type cap, are completely expelled.

This expulsion of air is also brought about by means of the foam which rises out of the bottle if a classical injecting device (7)—such as one which operates with hot water, for example—is utilized. The use of liquefied gas, preferably liquid nitrogen, is advantageous, however, since an intensive flow of the gas current can then be achieved. In this case, the crown-type cap (1) can, in order to protect the opening (3), be placed—in departure from the representation in FIGS. 2 and 3—directly onto the opening because, with the ongoing evaporation of the nitrogen in the bottle (2), the internal pressure increases until the crown-type cap is, as the result of the gas pressure which is exerted against the weaker force of the non-rigid spring (16), at least briefly raised up from the opening (3), in order for gas to escape into the open. After the displacement of the air, the closing tool (11) is further lowered by means of the control cam (18), by means of which the crown-type cap (1) is pressed against the opening (3) in a gas-tight manner and, by means of a further backwards movement of the closing cone (28) against the force of the hard spring (34), the edge (6) of the crown-type cap (1) is subsequently deformed radially in an inward direction, and engages behind the opening bulge of the bottle (2) (Position III).

Figure 4:
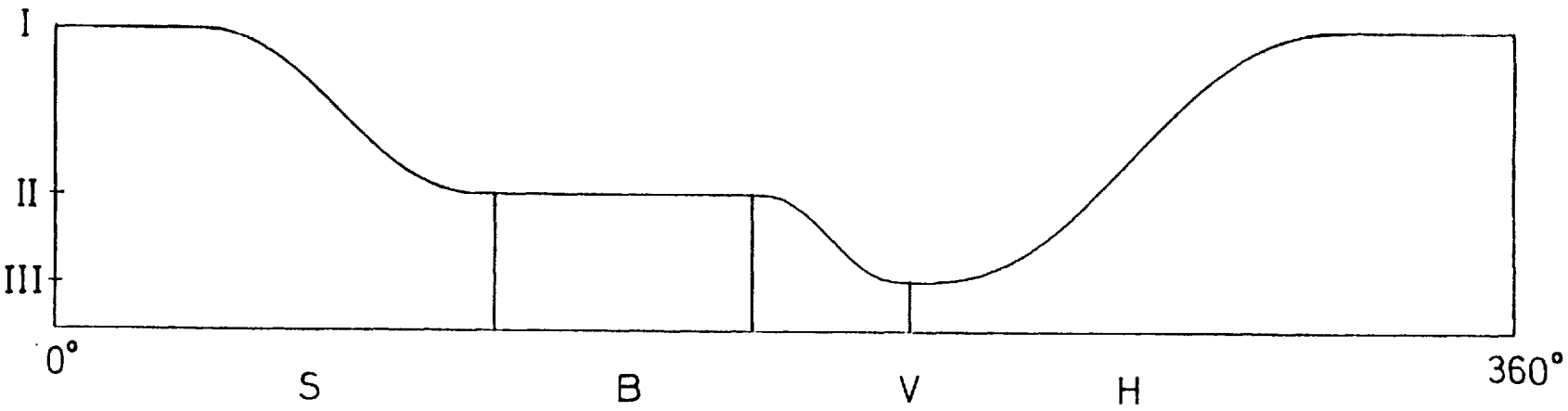
FIG. 4: A modification of the control cam of the closing machine which is depicted in FIG. 2.

The three relevant positions (I, II, III) of a closing tool (11), in accordance with the rotational position with a rotation with the rotor (10) of the closing machine (9), are evident from the development of the course of the cam of the control cam (18) which is depicted in FIG. 4. The initial position of a closing tool (11), which is depicted as zero degrees, is located at the closure cap conveyance station (39) (see FIG. 1). The uppermost position, which is the ready position of the closing tool (11), in which a cap unit (1) is conveyed through the closure cap conveyance station (39) to the magnet (12), and a bottle (2) is subsequently concentrically inserted through the transfer star wheel (30) below the closing tool (11), is designated as (I). By means of the lowering of the closing tool (Phase "S") into the protective position (II), which is positioned lower, the crown-type cap is moved forward, near the opening (3), into the position which is depicted in FIGS. 2 and 3, and is held, in a further process, for a little bit of time, whereby the cap unit is, in the manner which has previously been described, exposed to gas, on its internal side, by means of the gas which is exiting from the bottle (2) (Phase "B"). From this protective position (II), the closing tool (11) is subsequently lowered further until reaching the lowest position (III), which is the closing position (or Position "V"), and is again moved back, for the purpose of the release and the moving away of the bottle, which is now sealed, into the ready position (I) (Phase "H"), in order to again pick up a cap unit (1) at the conveyance station for the closure caps (39).

I claim:

1. An improved process for the processing of containers into which a fluid is injected after filling, before a mouth (3) of the container (2) is closed in a sealing manner by means of a closure cap (1), the improvement comprising the steps of, first, after the injection of the fluid, moving a closure cap (1) up to the mouth (3) of the container (2), next, positively holding said closure cap (1) in a protective position (II) above said mouth by means of a holding element (12), so that the mouth is covered by said closure cap, but a distance remains between said mouth and a lower side (36) of said closure cap (1) allowing gas to escape from said container (2) through an annular gap between said mouth and said closure cap to an ambient atmosphere having at least atmospheric pressure, waiting a predetermined length of time to allow gas, generated by said injected fluid outside of said container, to escape through said annular gap and during said predetermined length of time conveying together said container and said closure cap (1) while holding said closure cap parallel to said mouth and maintaining said distance in said protective position, and, after said predetermined length of time, lowering and attaching said closure cap to said container in a sealing manner.

2. A process in accordance with claim 1, and the step of spacing a lower side (36) of said closure cap (1), in said protective position (II), 1 to 3 millimeters away from said mouth (3).

3. A process in accordance with claim 1, wherein said fluid can be introduced, by means of an injecting device (7), through said mouth opening (3) and into said container (2), said fluid comprising liquid nitrogen.

4. A process in accordance with claim 1, and the step of waiting a first predetermined length of time after the injecting of the fluid into said container (2) before performing said step of holding said closure cap (1) in said protective position (II) near said mouth (3).

5. A process according to either claims 1 or 2, including the step of introducing said mouth (3) of the container into an upwardly-directed indentation (5) of said closure cap (1), whereby a bottom edge (6) of the closure cap is at a lower level than a top surface of said mouth (3) when said container is in the protective position (II).

6. A process in accordance with claim 1, and attaching said closure cap (1) to said container (2) by means of permanently deforming said closure cap.

7. A process in accordance with claim 6, and forming said closure cap (1) as a crown-type cap.

8. A process in accordance with claim 1, 2, 6, or 7, and holding said closure cap (1) in said protective position (II) by means of a closing tool (11) and subsequently using said closing tool means to attach said closure cap to said container (2).

9. An improved device for processing containers, into each of which a fluid is injected after filling before the mouth (3) of the container (2) is closed, by means of a closure cap (1), in a sealing manner, the improvement comprising a holding element (12) for the closure cap (1), which actuates said closure cap (1) so that, after the injection of the fluid, said closure cap approaches the mouth (3) of the container (2), and is positively held in a protective position (II) which protects said opening but a distance remains between said mouth and a lower side (36) of said closure cap (1) allowing gas, generated by said injected fluid inside of said container, to escape from said container (2) through an annular gap between said mouth (3) and said closure cap (1) to an ambient atmosphere having at least atmospheric pressure, and a closing tool (11) for attaching said closure cap to said container, whereby in said protective position said container, said closure cap and said holding element move together and said element (12) holds said closure cap parallel to said mouth maintaining said distance in a protective position.

10. A device in accordance with claim 9, wherein said holding element (12) is constructed as a magnet, and is integrated into a pushing rod (13) of said closing tool (11).

11. A device in accordance with claim 9, wherein said holding element (12) and said closing tool (11) can be controlled in height relative to said mouth (3) of said container (2), and said holding element (12) is integral with said closing tool (11).

12. A device in accordance with claim 11, wherein a height-control device (18) is in controlling relationship with said closing tool (11) and said holding element (12), by means of which said closing tool (11) and said holding element (12) can be moved from a stand-by position (I), at which said closure cap (1) can be supplied to the holding element (12), and a said container (2) can be introduced into either of said holding element (12) or said closing tool (11), to said protective position (II).

13. A device in accordance with claim 12, wherein said height control device (18) can further move said holding element (12) and said closing tool (11) to a third position (III) which is closer to said mouth (3) to facilitate securing said closure cap onto said mouth, and said height control device (18) can further return to said stand-by position (I) to facilitate removal of a closed container.

14. A device in accordance with claim 12, wherein said height-control device (18) comprises a control cam, and wherein in said protective position (II), there is an aperture (4) for gas to escape from said container (2) between said closure cap (1) and said mouth (3).

15. A device in accordance with claim 9, 11, 12, 13, or 10, wherein several said closing tools (11), with one said holding element (12) each, are positioned in a manner distributed circumferentially around a rotor (10) which can be driven in a rotational manner thereby causing rotation of said closing tools (11), and said containers (2) which are to be closed can be moved into and out of said respective closing tools in a manner which is continuous and synchrononous with said rotation of said closing tools (11).

16. A device in accordance with claim 9, 11, 12, 13, or 10, wherein at least one guide roller (14, 15) is associated with every said closing tool (11), each of said guide rollers abutting against a stationary control cam (18) which determines said closing tool's (11) location.

17. A device in accordance with claim 9, and including an injecting device (7), said injecting device positioned adjacent a rotor (10) which carries said holding element (12) and said closing too (11) above a transfer star wheel (30), said star wheel connecting a filling machine carousel (8) with said rotor (10).

18. A device in accordance with claim 17, wherein said injecting device's (7) location relative to said transfer star wheel (30) is adjustable.

19. A device in accordance with claim 17 or 18, wherein said injecting device (7) releases liquefied gas said liquefied gas comprising liquid nitrogen.

20. A device in accordance with claim 9, 11, 12, 13, 10, 14, 17, or 18, wherein the injection pressure of the fluid can vary proportionately to a speed at which said device operates to transport said containers.

* * * * *

UNITED STATES PATENT AND TRADEMARK OFFICE

CERTIFICATE OF CORRECTION

PATENT NO. : 5,802,812

DATED : September 8, 1998

INVENTOR(S) : Gerhard Heudecker

It is certified that error appears in the above-indentified patent and that said Letters Patent is hereby corrected as shown below:

In Claim 1, line 15, "outside" should be --inside-- per

Signed and Sealed this

Fifteenth Day of December, 1998

*Attest:*

*Attesting Officer*

BRUCE LEHMAN

*Commissioner of Patents and Trademarks*